US011208255B2

(12) United States Patent
Suzuki

(10) Patent No.: US 11,208,255 B2
(45) Date of Patent: Dec. 28, 2021

(54) FIXED QUANTITY INJECTION UNIT

(71) Applicant: MITANI VALVE CO., LTD., Tokyo (JP)

(72) Inventor: Masato Suzuki, Tokyo (JP)

(73) Assignee: MITANI VALVE CO., LTD., Tokyo (JP)

( * ) Notice: Subject to any disclaimer, the term of this patent is extended or adjusted under 35 U.S.C. 154(b) by 0 days.

(21) Appl. No.: 17/044,036

(22) PCT Filed: Mar. 12, 2019

(86) PCT No.: PCT/JP2019/010054
§ 371 (c)(1),
(2) Date: Sep. 30, 2020

(87) PCT Pub. No.: WO2019/202882
PCT Pub. Date: Oct. 24, 2019

(65) Prior Publication Data

US 2021/0107729 A1 Apr. 15, 2021

(30) Foreign Application Priority Data

Apr. 18, 2018 (JP) ..... JP2018-080114

(51) Int. Cl.
*B65D 83/54* (2006.01)
*B65D 83/20* (2006.01)

(52) U.S. Cl.
CPC ..... *B65D 83/54* (2013.01); *B65D 83/205* (2013.01)

(58) Field of Classification Search
CPC .... B65D 83/205; B65D 83/54; B65D 83/206; B65D 83/52; A23J 1/04; A23J 3/04;
(Continued)

(56) References Cited

U.S. PATENT DOCUMENTS 2,454,621 A * 11/1948 Allen ..... A62C 13/003 222/402.15
3,913,609 A * 10/1975 Remane ..... F24C 3/14 137/322

(Continued)

FOREIGN PATENT DOCUMENTS

JP H07-008273 U 2/1995
JP 4144688 B2 9/2008

(Continued)

OTHER PUBLICATIONS

PCT, International Preliminary Report on Patentability for the corresponding application No. PCT/JP2019/010054, dated Jun. 11, 2019, with English translation.

(Continued)

*Primary Examiner* — Vishal Pancholi
*Assistant Examiner* — Bob Zadeh
(74) *Attorney, Agent, or Firm* — Lucas & Mercanti, LLP

(57) ABSTRACT

A certain amount of contents is easily sprayed by one pressing operation. A metered spray unit 10 being mounted on a stem 23 of a valve 22 that is provided on the upper portion of a container body 21, configured to spray a certain amount of contents in a container body 21, includes an outer cylinder 30 which is provided with a stem insertion hole 30*a* into which the tip of the stem 23 is inserted and the inner wall thereof is fixed to the stem, a metering chamber 35 connected to the stem insertion hole 30*a*, the metering chamber being an internal space having a predetermined capacity, connected to the stem insertion hole 30*a*, and an spray port 33 communicating with the metering chamber 35, a plug member 40 that is inserted from the inside of the metering chamber 35 into the spray port 33 for blocking the spray port 33, a push button 51, an elastic member 60 for supporting the push button 51 on the outer cylinder 30, and a shaft member 50 connected to the push button 51. The (Continued)

elastic member 60 has an amount of displacement due to the pressing force applied to the push button 51, being smaller than the amount of displacement when applying the same pressing force to the spring for urging the stem 23 within the valve 22.

13 Claims, 6 Drawing Sheets

(58) Field of Classification Search
CPC .. B02C 18/00; C07K 1/36; C11B 1/10; C11B 1/108; C11B 1/12; C11B 13/00; C11B 3/001; C11B 3/16; Y02W 30/74
See application file for complete search history.

(56) References Cited

U.S. PATENT DOCUMENTS 4,413,781 A * 11/1983 Iwata ..... F02M 49/02 239/409
4,453,650 A * 6/1984 Witte ..... B65D 83/201 222/402.14
6,302,297 B1 * 10/2001 Richardson ..... B25C 1/08 222/1
7,445,136 B2 * 11/2008 Lin ..... F17C 13/04 222/402.1
2004/0226966 A1 * 11/2004 Carlucci ..... B65D 83/207 222/146.5
2019/0275541 A1 * 9/2019 Schmid ..... G01F 11/025
2021/0107729 A1 * 4/2021 Suzuki ..... B65D 83/54

FOREIGN PATENT DOCUMENTS

JP 4747325 B2 8/2011
JP 4935276 B2 5/2012
JP 4973985 B2 7/2012
JP 2013-180802 A 9/2013
JP 2015-131681 A 7/2015

OTHER PUBLICATIONS

PCT, International Search Report for the corresponding application No. PCT/JP2019/010054, dated Jun. 11, 2019, with English translation.

* cited by examiner (a)

(b)

FIXED QUANTITY INJECTION UNIT

CROSS REFERENCE TO RELATED APPLICATION

This Application is a 371 of PCT/JP2019/010054 filed Mar. 12, 2019, which, in turn, claims priority of the Japanese patent application no. 2018-080114, filed Apr. 18, 2018, the above applications are incorporated herein by reference.

TECHNICAL FIELD

The present invention relates to a metered spray unit for spraying a certain amount of contents stored in a container.

BACKGROUND OF THE INVENTION

Conventional aerosol spray containers include a container body for storing contents and a valve at an upper portion of the container body, with a stem at a center of the valve, the stem being movable downward and communicating a space inside the container body with an external space.

As one of such aerosol type spray containers, there has been proposed a metered spray container having a metered spray mechanism for spraying a predetermined amount of contents each time a user uses the spray container. The metered spray container may include a metered spray unit inside the valve, or a detachable metered spray unit outside (on the top of) the valve. When the metered spray unit is provided on the top of the valve, the valve can be manufactured at low cost because there is no need to complicate the configuration in the valve. It is also possible to mount the metered spray mechanism on top of an existing valve.

A conventional metered spray unit is provided with a metering chamber capable of storing a certain quantity of contents inside. The certain quantity of contents in the container body is filled into the metering chamber via a stem, and then it is sprayed from a spray port to the outside of the metered spray unit. For example, in the metered spray unit as disclosed in Patent Documents 1 to 3, when a user presses a button, the spray port is closed, and then the stem is pressed to fill a predetermined amount of the contents into the metering chamber. Next, when the user releases the depression of the button, the spray port is opened after the stem is returned, and the contents filled in the metering chamber are sprayed from the metered spray unit.

On the other hand, Patent Document 4 discloses a metered spray unit in which when a user presses a button, the contents filled in the metering chamber are sprayed to the outside of the metered spray unit, and when the button is released from being pressed, a certain amount of the contents is filled in the metering chamber.

PRIOR ART DOCUMENT

Patent Document

[Patent Document 1]
Japanese Patent No. 4,144,688
[Patent Document 2]
Japanese Patent No. 4,747,325
[Patent Document 3]
Japanese Patent No. 4,935,276
[Patent Document 4]
Japanese Patent No. 4,973,985

SUMMARY OF THE INVENTION

Problem to be Solved by the Invention

In the conventional metered spray units as disclosed in Patent Documents 1 to 3, a certain amount of contents is spayed, when the user releases the finger from the button after pressing the button with the finger, as described above. Therefore, the operation of such conventional metered spray unit is different from the configuration where the contents are sprayed by a usual pressing operation, and when a user familiar with the usual operation of the spray unit operates the conventional metered spray unit, the user may feel uncomfortable with the difference in the timing of spraying.

On the other hand, in the metered spray unit of Patent Document 4, the contents are sprayed at the timing when the user presses the push button. Since the contents are filled in the metering chamber at the time of return of the push button, the contents are filled in the metering chamber until the next spraying, and there is a possibility that the contents in the metering chamber are brought into contact with air.

It is an object of the present invention to easily spray a certain amount of the contents in one pressing operation.

Means for Solving the Problems

In order to achieve the above object, the metered spray unit of the present invention is mounted on a stem of a valve provided at an upper portion of the container body for spraying a certain amount of contents in the container body. The metered spray unit includes;

an outer cylinder provided with a stem insertion hole into which a tip of a stem is inserted and an inner wall of the stem insertion hole is fixed to the stem, a metering chamber being an internal space having a predetermined capacity connected to the stem insertion hole, and a spray port communicating with the metering chamber, a plug member inserted into the spray port from the inside of the metering chamber, to block the spray port, a push button, an elastic member supporting the push button on the outer cylinder, and a shaft member connected to the push button.

A displacement amount of the elastic member due to the pressing force applied to the push button is smaller than the displacement amount when applying the same pressing force to a spring for urging the stem within the valve.

Effect of the Invention

According to the present invention, it is possible both to fill the contents in the metered spray unit and to spray a certain amount of the contents out of the metered spray unit, by one pressing operation. Therefore, the present invention can facilitate the operation for spraying a constant amount of the contents. Further, it is also possible to prevent the contents from remaining in the metering chamber after spraying the constant amount.

DESCRIPTION OF EMBODIMENTS

Hereinafter, a metered spray unit according to an embodiment of the present invention will be described.

Figure 1:
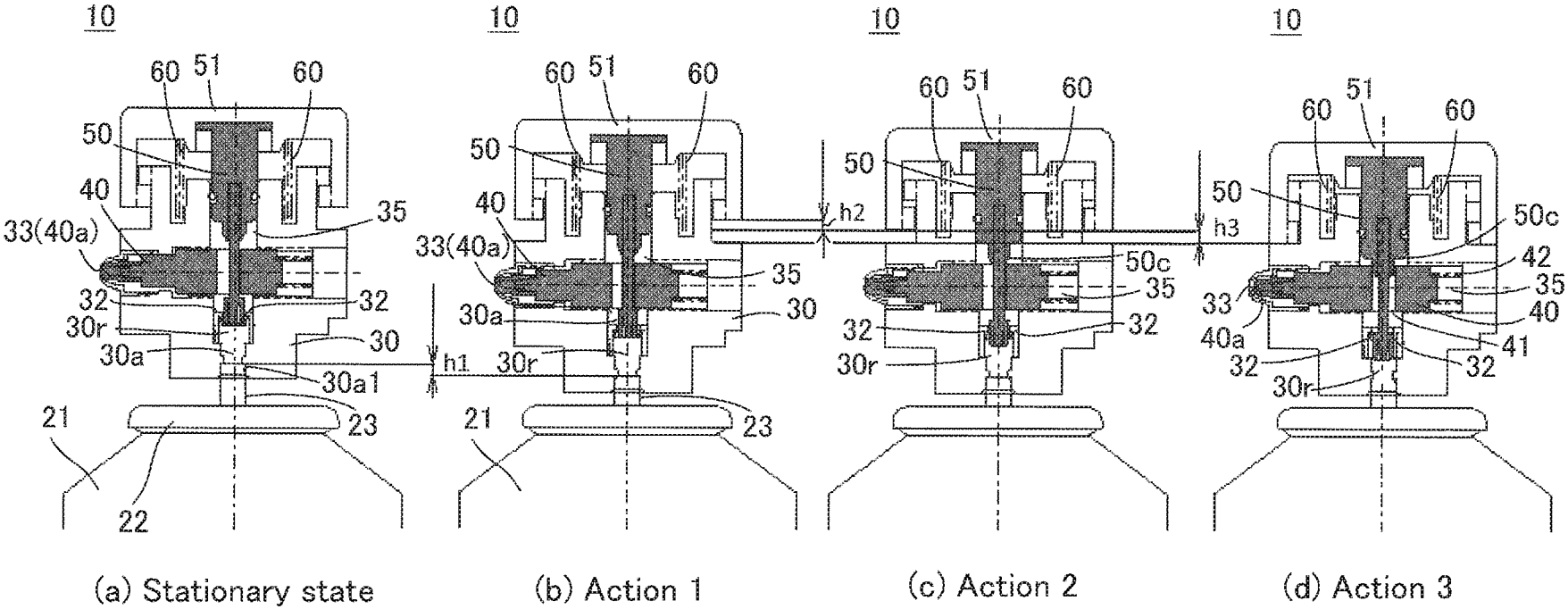
FIG. 1(*a*) to FIG. 1(*d*) are sectional views showing an operation example of a metered spray unit 10 according to an embodiment.
Figure 2:
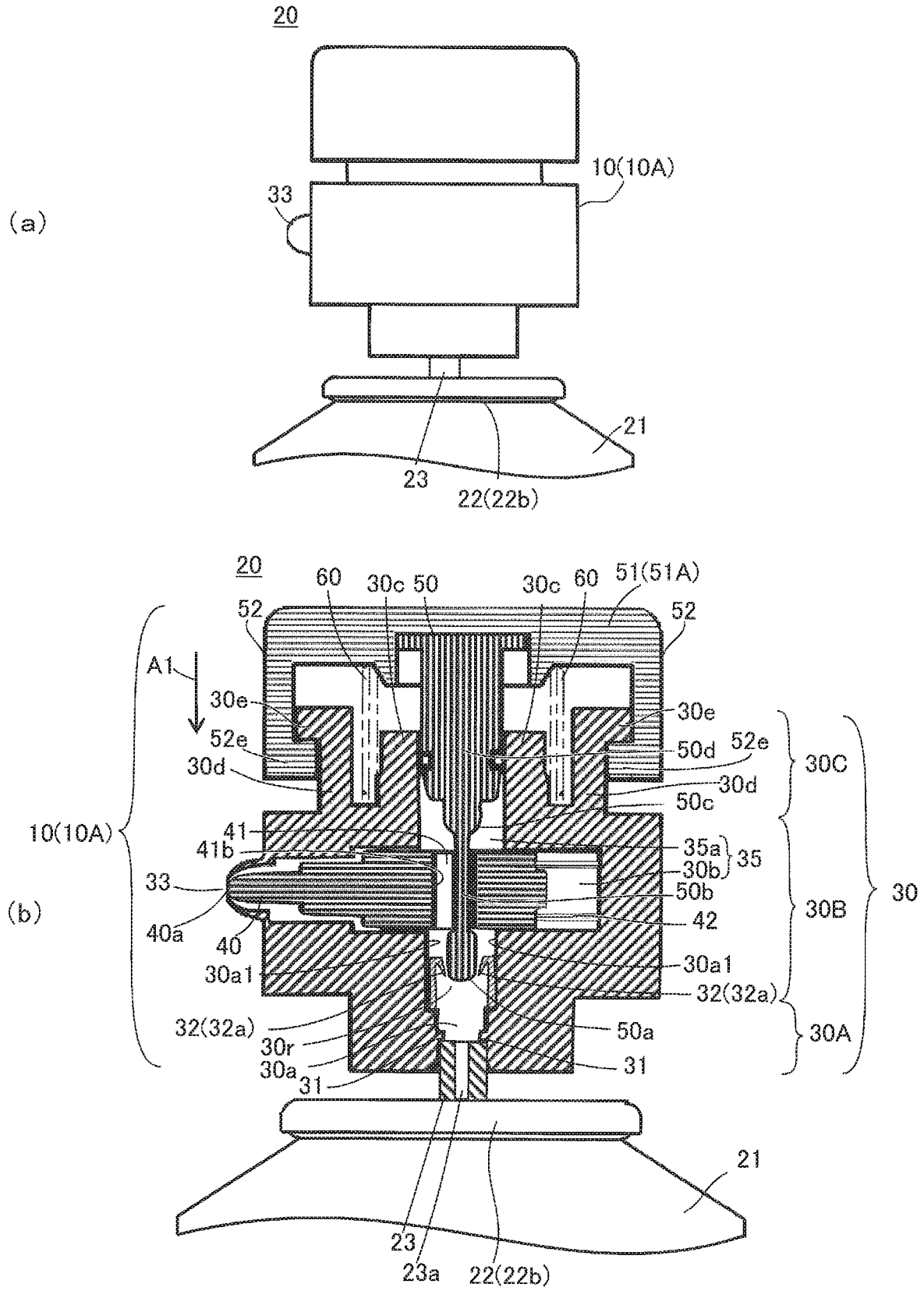
FIG. 2(*a*) is a side view and FIG. 2(*b*) is a cross-sectional view of a metered spray container 20.

First, with reference to FIGS. 1 to 4, a main configuration example and an operation example of the metered spray unit 10 will be described. FIG. 1 shows an example of the operation of the metered spray unit 10 when the user presses the metered spray unit 10. FIGS. 2(*a*) and 2(*b*) show the operation of the metered spray unit 10 in the same stationary state as shown in FIG. 1(*a*). Similarly, FIG. 3 (*a*) is associated with FIG. 1(*b*), FIG. 3(*b*) is associated with FIG. 1(*c*), and FIG. 4 is associated with FIG. 1(*d*).

As shown in FIG. 1 (*a*), FIG. 2 (*a*), and FIG. 2(*b*), the metered spray unit 10 is mounted on a stem 23 of a valve 22 provided on the top of a container body 21 for storing contents. When the user presses the metered spray unit 10, the stem 23 is pressed, and a constant amount of the contents in the container body 21 is sprayed out. In the following description, when referring to the vertical direction, the bottom of the container body 21 indicates the lower side, and the side on which the valve 22 is attached indicates the upper side.

As shown in FIG. 1(*a*), FIG. 2 (*a*) and FIG. 2(*b*), the metered spray unit 10 includes an outer cylinder 30, a plug member 40, a push button 51, an elastic member 60, and a shaft member 50. The outer cylinder 30 includes a stem insertion hole 30*a* into which a tip end of the stem 23 is inserted with an inner wall 30*a*1 fixed to the stem 23, a metering chamber 35 which is an internal space having a predetermined capacity and connected to the stem insertion hole 30*a*, and an spray port 33 communicating with the metering chamber 35. The plug member 40 is inserted into the spray port 33 from the inside of the metering chamber 35, and blocks the spray port 33. The push button 51 is operated by the user. The elastic member 60 supports the push button 51 on the outer cylinder 30. The shaft member 50 is connected to the push button 51. Elastic modulus of the elastic member 60 is designed in such a manner that the amount of displacement due to the pressing force applied to the push button 51 is smaller than the amount of displacement due to the same pressing force that is applied to the spring for urging the stem 23 within the valve 22.

The upper end of the shaft member 50 is fixed to the push button 51. The shaft member 50 is structured to be lowered with the depression of the push button 51 to close the opening of the connecting portion 30*r* that is configured to connect the metering chamber 35 with the stem insertion hole 30*a*, and also structured to move the plug member 40 in a direction to open the spray port 33 while maintaining the clogging of the opening. A valve 32 having flexibility is disposed on the inner periphery of the opening of the connecting portion 30*r* between the metering chamber 35 and the stem insertion hole 30*a*.

In FIG. 1(*a*) and FIG. 2, the push button 51 is not pressed by the user and the stem 23 is not pressed in the axial direction. That is, those figures show the state of the metered spray unit 10 at the timing when the spraying operation is not made (referred to as a stationary state). When the push button 51 is pressed in the stationary state, as shown in FIG. 1(*b*) and FIG. 3(*a*), the outer cylinder 30 and the stem 23 are lowered more than the displacement amount of the elastic member 60 (Action 1 and Displacement h1 in FIG. 1(*b*)), and the stem 23 injects the contents into the stem insertion hole 30*a*. The contents injected into the stem insertion hole 30*a* flow into the metering chamber 35 from the opening of the connecting portion 30*r* as shown in FIG. 3(*a*), and the metering chamber 35 is filled with the contents.

Figure 3:
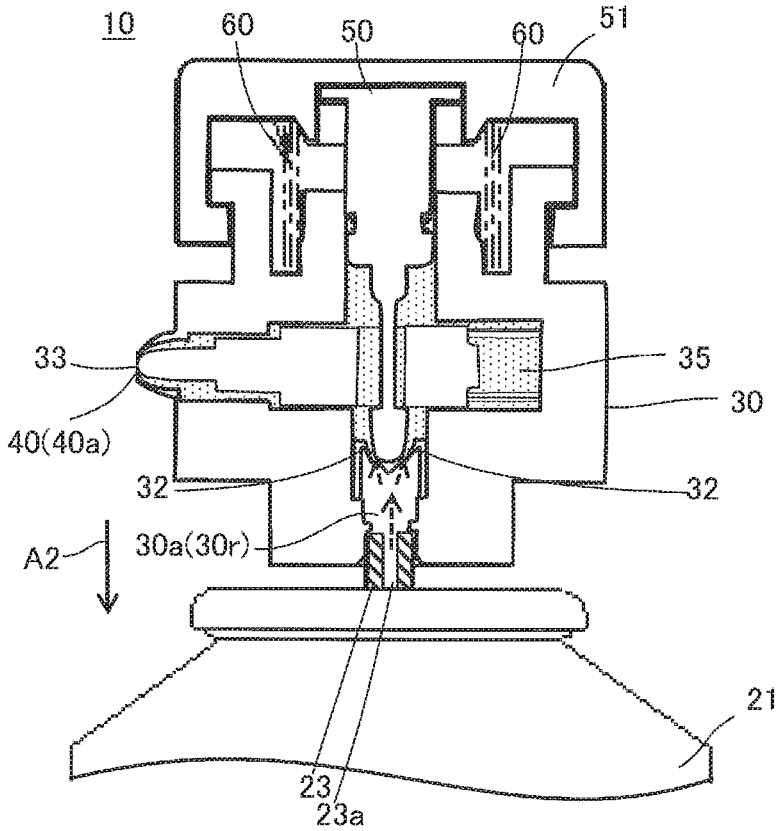
FIG. 3(*a*) and FIG. 3(*b*) are cross-sectional views showing an example of operation of the metered spray unit 10.
Figure 3:
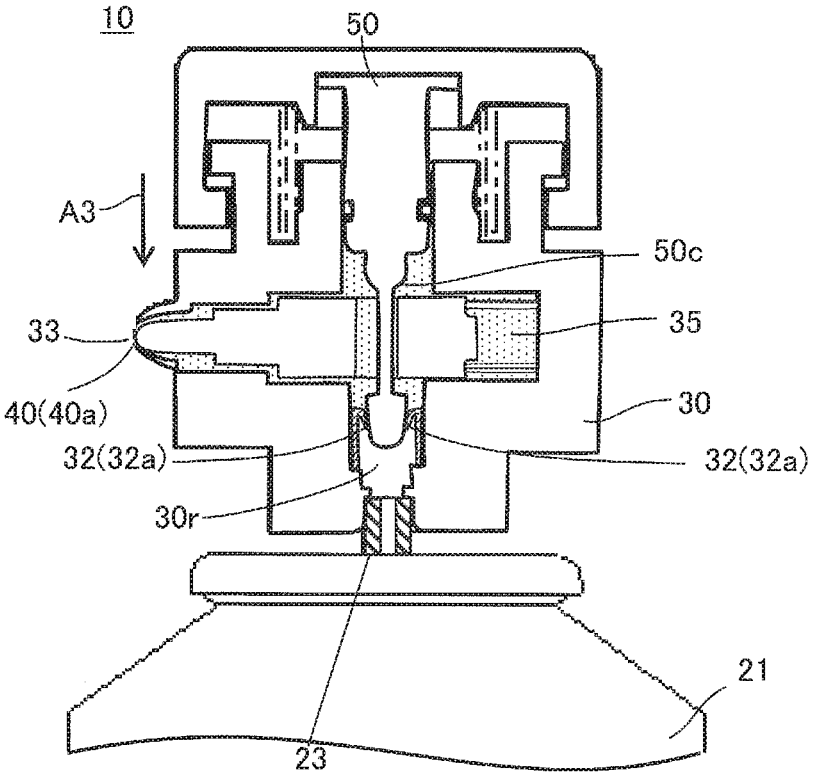
Figure 4:
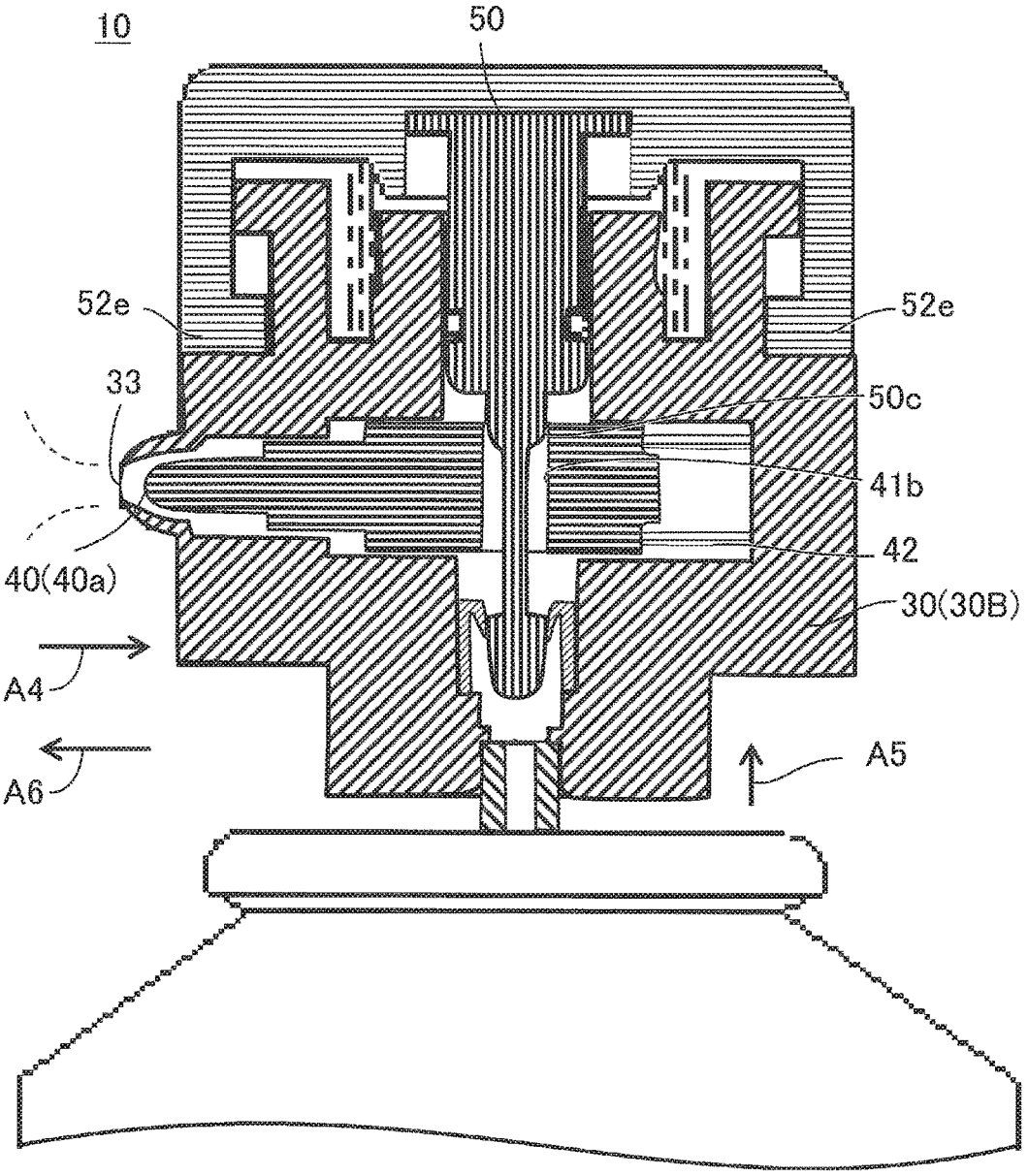
FIG. 4 is a cross-sectional view showing an example of operation of the metered spray unit 10.

When the push button 51 is pressed further, as shown in FIG. 1(*c*) and FIG. 3(*b*), the tip (the lower end) of the shaft member 50 is inserted into the valve 32 due to the displacement of the elastic member 60 (Action 2 and Displacement h2 in FIG. 1(*c*)). Thus, since the opening of the connecting portion 30*r* is closed, the inflow of the contents into the metering chamber 35 stops.

When the push button 51 is pressed further, as shown in FIG. 1(*d*) and FIG. 4, the shaft member 50 is lowered by displacement of the elastic member 60, and a protrusion 50*c* provided on the shaft member 50 is brought into contact with the plug member 40, to push and move the plug member 40 in a direction to open the spray port 33 (Action 3 and Displacement h3 in FIG. 1(*d*)). As a result, the spray port 33 is opened, and the contents filled in the metering chamber 35 are sprayed from the spray port 33.

In other words, with pressing the push button 51, lowering of the outer cylinder 30 and the stem 23, closing the opening of the connecting portion 30*r* by the shaft member 50, and opening of the spray port 33 by the plug member 40 occur in this order. After the spraying, when the user releases his/her hand from the push button 51, the actions opposite to the above-described actions occur in the reverse order, and the push button 51 is returned.

In the metered spray unit 10, one-time pushing of the metered spray unit 10 by a user allows the actions as described above. Therefore, it is easy for the user who is accustomed to the operation of general spray units to perform the operation of spraying a constant amount of the contents, and it is further possible to prevent the contents from remaining in the metering chamber 35 after spraying the constant amount. Hereinafter, a specific configuration of the metered spray unit 10 will be described.

As shown in FIG. 2 (*b*), the outer cylinder 30 has a cylindrical stem insertion hole 30*a* penetrating in a direction along its central axis, and a hollow portion 30*b* perpendicular to the stem insertion hole 30*a*. The stem insertion hole 30*a* has an inner diameter whose inner wall holds the airtight in close contact with the outer wall of the stem 23.

The metering chamber 35 is a space that is formed by; an axial space 35*a* connected to the stem insertion hole 30*a* of the outer cylinder 30 and the hollow portion 30*b* expanding in the radial direction and communicating with the spray port 33. The tip of the shaft member 50 is inserted into the valve 32, and the tip of the shaft member 50 and the valve 32 are brought into close contact with each other to close the opening of the connecting portion 30*r*, thereby forming the lower end portion of the metering chamber 35. The outer peripheral surface of the shaft portion 50*d* of the upper portion of the shaft member 50 is brought into contact with the inner peripheral surface of the cylinder 30*c*, thereby forming the upper end portion of the metering chamber 35. Since the capacity of the contents in the metering chamber 35 is constant, a constant amount of the contents sprayed from the stem 23 is stored in the metering chamber 35 every time the push button 51 is pressed, without being influenced by the user's pushing force, or the like.

The shaft member 50 is arranged so that its axial direction coincides with the axial direction of the stem 23, and the shaft member 50 has the tip which is directed downward. This tip is designed to have a size such that, when inserted into the opening of the connecting portion 30*r* between the metering chamber 35 and the stem insertion hole 30*a*, the opening of the connecting portion 30*r* is closed and sealed.

The entirety of the plug member 40 is disposed in the metering chamber 35 (hollow portion 30*b*) of the outer cylinder 30, and it is movable within the metering chamber 35. The plug member 40 has a through hole 41 through which the shaft member 50 passes in the axial direction, and the shaft member 50 is disposed to pass through the through hole 41 of the plug member 40.

The plug member 40 includes a tip 40*a*, and a rear end positioned on the opposite side of the tip 40*a* across the through hole 41. The rear end is provided with a second elastic member 42 for urging the tip 40*a* of the plug member 40, in a direction to press the tip 40*a* toward the spray port 33. With this configuration, the tip end 40*a* of the plug member 40 blocks the spray port 33 in the stationary state.

(Operation Example of Metered Spray Unit 10)

Next, details of an operation example of the metered spray unit 10 of the present embodiment will be described with reference to FIGS. 1 to 4. In FIG. 3, for the sake of explanation, hatching of each member of the metered spray unit 10 is omitted, and the contents filled in the metering chamber 35 are indicated by a texture.

In the state where the push button 51 is not operated by the user, i.e. in the stationary state, as shown in FIG. 1 (*a*) and FIG. 2 (*b*), the elastic member 60 urges the push button 51 in a direction away from the stem 23 (upwardly). Thus, the shaft member 50 whose upper end is fixed to the push button 51 is also urged in an upward direction away from the stem 23 along the axial direction of the stem 23. Therefore, in the stationary state, both the shaft member 50 and the stem 23 are not pressed and located at the uppermost portion. Accordingly, an ejection valve (not shown) provided in the stem 23 is in the closed state, and the container body 21 is isolated from the external space, so that the contents are not filled in the metering chamber 35.

In the stationary state, the tip of the shaft member 50 is positioned above the valve 32, and the shaft member 50 does not close the opening of the connecting portion 30*r*. Further, the protrusion 50*c* of the shaft member 50 is not in contact with the plug member 40, and the tip 40*a* of the plug member 40 is pressed against the spray port 33 to block the spray port 33.

In this state of stationary, when the user presses the push button 51 in the axial direction of the stem 23 with a finger or a similar thing (Arrow A1 in FIG. 2 (*b*)), the spring of the stem 23 is pushed and contracted prior to contraction of the elastic member 60, because the displacement amount of the elastic member 60 due to the pressing force applied to the push button 51 is designed to be smaller than the displacement amount of the stem when the same pressing force is applied to the spring for urging the stem 23. Therefore, without moving the shaft member 50 relative to the outer cylinder 30, the stem 23 and the outer cylinder 30 are lowered along the axial direction.

When the stem 23 is lowered, the ejection valve of the stem 23 is opened, due to a pressure difference between the pressure higher than the atmospheric pressure within the container body 21 and the atmospheric pressure within the metered spray unit 10, and the contents in the container body 21 are ejected from the hole 23*a* of the stem 23. At this time, as shown in FIGS. 1 (*b*) and 3 (*a*), since the opening of the connecting portion 30*r* is not closed by the shaft member 50, the spouted contents flow into the metering chamber 35 through the stem insertion hole 30*a* and the connecting portion 30*r* of the outer cylinder 30. Since the spray port 33 of the metering chamber 35 is blocked by the tip 40*a* of the plug member 40, the contents are not yet sprayed from the spray port 33.

When the user further presses the push button 51 in the axial direction of the stem 23 (Arrow A2 in FIG. 3 (*a*)) and the stem 23 is moved to the lower end of the movable range, the contents are filled over the entire metering chamber 35.

When the user presses the push button 51 furthermore in the axial direction of the stem 23 (Arrow A2), the stem 23 is already moved to the lower end of the movable range and it cannot be lowered further, causing contraction of the elastic member 60, and then allowing the shaft member 50 to approach the stem 23.

Then, as shown in FIG. 1(*c*) and FIG. 3(*b*), the tip of the shaft member 50 is inserted into the valve 32, and the shaft member 50 closes the opening of the connecting portion 30*r*, thereby stopping the inflow of the contents into the metering chamber 35. When the shaft member 50 closes the opening of the connecting portion 30*r*, the pressure inside the container body 21 and the pressure inside the connecting portion 30*r* become the same, and thus the ejection of the contents from the stem 23 stops. At this time, the spray port 33 of the metering chamber 35 is still blocked by the tip 40*a* of the plug member 40, and the contents are not sprayed from the spray port 33.

At this moment, the contents are filled in the metering chamber 35 in the state of vaporized liquid gas, and the amount of the contents filling the inside of the metering chamber 35 is constant.

When the user presses the push button 51 furthermore in the axial direction of the stem 23 (Arrow A3 in FIG. 3(*b*)), the elastic member 60 is contracted more and the shaft member 50 approaches the stem 23.

Then, as shown in FIG. 1(*d*) and FIG. 4, the protrusion 50*c* descends as the push button 51 is pressed, and is inserted into the through hole 41 of the plug member 40. Then, the protrusion 50*c* presses the inner peripheral surface 41*b* of the through hole 41, in contact with the inner peripheral surface 41*b*, pushing and moving the plug member 40 in a direction perpendicular to the axial direction of the shaft member 50. Thus, the tip 40*a* of the plug member 40 is moved away from the spray port 33, to open the spray port 33 (Arrow A4 in FIG. 4).

When the spray port 33 is opened, the contents filling the metering chamber 35 is sprayed from the spray port 33. When the spray port 33 is opened, the contents are jetted at once, since they are in the state of vaporized liquid gas.

At this time, the shaft member 50 moves further downward from the state of closing the opening of the connecting portion 30*r*, and the valve 32 pushed by the shaft member 50 is deflected, thereby closing the opening of the connecting portion 30*r* in close contact with the valve 32. This state indicates that the shaft member 50 is positioned at the lowest point.

When the user weakens the force to depress the push button 51, the elastic member 60 tries to return to the original position before the spring of the stem 23 is restored, because the elastic force of the elastic member 60 is stronger than the elastic force of the spring urging the stem 23. Then, each member of the metered spray unit 10 operates in reverse order, compared to the situation where the push button 51 is depressed. The push button 51 is raised by the elastic force of the elastic member 60, and along with this, the shaft member 50 is moved upward within the outer cylinder 30 (Arrow A5 in FIG. 4).

When the shaft member 50 is moved upward, the force having been pushing the plug member 40 is released, and the plug member 40 is pushed back to the tip 40*a* side by the elastic member 42 (Arrow A6). At this moment, the shaft member 50 moves upward with respect to the valve 32, and the deflection of the valve 32 is released.

When the plug member 40 is pushed back to the tip side 40*a* side and the tip 40*a* of the plug member 40 blocks the spray port 33 as shown in FIG. 3 (*b*), spraying of the contents from the spray port 33 stops.

When the user further weakens the force to depress the push button 51, the push button 51 and the shaft member 50 are raised further by the elastic force of the elastic member 60, and each member of the metered spray unit 10 as shown in FIG. 1(*a*) and FIG. 2(*b*) returns to the stationary state. At this time, since the shaft member 50 is also moved away from the valve 32, the blocking of the opening of the connecting portion 30*r* by the shaft member 50 is released.

When depression of the push button 51 is canceled along with releasing a thing such as the user's finger from the bush button 51, the stem 23 is pushed up integrally with the metered spray unit 10 by the elastic force of the spring of the stem 23, and returns to the position in the stationary state. Thus, the ejection valve of the stem 23 is closed, the container body 21 is again cut off from the outer space.

In this manner, a single pressing operation of the push button 51 by the user allows the metered spray unit 10 to perform an operation of filling the contents into the metering chamber 35 and an operation of spraying the filled contents out of the metered spray unit 10 through the spray port 33.

In addition, the metered spray unit 10 allows the shaft member 50 and the plug member 40 to move within the metering chamber 35, so that all the contents in the metering chamber 35 can be sprayed from the spray port 33. Therefore, the contents filled in the metering chamber 35 do not remain in the metering chamber 35. Accordingly, the contents in the metering chamber 35 are not brought into contact with air after use of a metered spray container 20.

In the metered spray unit 10, the movement of the shaft member 50 enables both the operation of opening and closing the connecting portion 30*r* that serves as an inlet for the contents to flow into the metering chamber 35, and the operation of opening and closing the spray port 33, and thus the metered spray unit can be configured with a small number of parts.

The metered spray unit 10 can also be mounted to any valve, regardless of the size of the valve, because it is used as an attachment to the stem 23. Hereinafter, a supplementary description will be given concerning the overall configuration of the metered spray container 20 provided with the metered spray unit 10.

The container body 21 is a rotating body having a center axis as the center. The contents to be stored in the container body 21 may include a liquid agent in which a medicine component, a solvent, and other additives are appropriately mixed depending on usage as required. In addition to the liquid agent, the contents may include a liquefied gas or a compressed gas soluble in the liquid agent, as a propellant for spraying the liquid agent.

The valve 22 is provided with a mountain cup 22*b* covering the upper opening of the container body 21, and the stem 23 is provided at the center of the mountain cup 22*b* (on the center axis of the container body 21). A part of the upper portion of the stem 23 is located outside the valve 22, the remaining part is located in the container body 21, and it is urged upward by a spring (not shown).

Although not illustrated, the metered spray container 20 may be provided with a cap covering at least a part of the metered spray unit 10, and the cap may be detachable from the metered spray container 20.

Unless otherwise specified, as a material of each of the parts constituting the metered spray container 20, any material may be selected and used according to usage, from materials such as plastic, rubber, metal, and ceramic, which are employed for a general container, as long as the material is not affected by the contents.

(Metered Spray Unit 10A of Embodiment 1)

With reference to FIG. 2(*b*), the metered spray unit 10A of the first embodiment will be described specifically in detail. The outer cylinder 30 of the metered spray unit 10A has a central axis coincident with the central axis of the stem 23 and cylinders in different diameters that are laminated to form a single piece. Specifically, the outer cylinder 30 comprises an outer cylinder lower portion 30A, and the outer cylinder middle portion 30B, and the outer cylinder upper portion 30C, in the order from the cylinder that is attached to the stem 23.

The outer cylinder lower portion 30A has a step 31 which engages with the upper end edge of the stem 23, on the lower end of the inner wall 30*a*1. Above the step 31 of the inner wall 30*a*1, there is provided the valve 32. The valve 32 has a circular shape that is bent inwardly downward from the upper end of the cylinder, and the bent tip 32*a* facing the stem 23 side. The circular central axis of the tip 32*a* is coincident with the central axis of the stem 23. The valve 32 preferably comprises a material which is elastically deformed easily by applying a force, such as a resin like polyethylene, and a rubber member.

Inside the outer cylinder middle portion 30B, the hollow portion 30*b* is provided, and the spray port 33 protrudes from the outer periphery of the outer cylinder middle portion 30B.

The outer cylinder upper portion 30C is provided with a cylinder 30*c*, and the inner peripheral surface of the cylinder 30*c* guides the vertical movement of the shaft member 50. Further, the outer cylinder upper portion 30C includes a cylinder 30*d*, on the outer peripheral side of the cylinder 30*c*. An outer rim expanding in the outer peripheral direction on the upper end of the cylinder 30*d*, forms an annular portion 30*e* that has a thickness in the vertical direction.

The plug member 40 has a shape becoming narrower toward the tip 40*a* on the spray port 33 side, relative to the through hole 41 side. Both ends of the elastic member 42 are fixed to the rear end of the plug member 40, and to the inner wall of the outer cylinder middle portion 30B, respectively. In the stationary state, the center of the through hole 41 of the plug member 40 is located closer to the tip 40*a*, than the central axis of the stem 23.

The outer peripheral surface of the plug member 40 may be provided with grooves, ribs, or the like, and the contents may be allowed to move around the plug member 40 along such grooves and ribs. Further, the plug member 40 may have a hole penetrating in a direction expanding in the radial direction from the through hole 41, in order to move the contents from the through hole 41 to the periphery of the plug member 40.

On the other hand, the shaft member 50 is provided with a prolate spheroid portion 50*a* being long in the vertical direction, a shaft portion 50*b*, a protrusion 50*c* for guiding the movement of the plug member 40, and a shaft portion 50*d*, in the order from the lower end close to the stem 23.

The diameter of the largest diameter part of the prolate spheroid portion 50*a* is larger than the diameter of the tip 32*a* of the valve 32. Therefore, when the shaft member 50 approaches the stem 23, the prolate spheroid portion 50*a* comes into contact with the tip 32*a*, and when the shaft member 50 further approaches the stem 23, the tip 32*a* of the valve 32 is pressed and deflected, so as to block the connecting portion 30*r* in close contact with the valve 32.

The shaft portion 50*b* is a cylindrical shaft that penetrates the through hole 41 of the plug member 40, the length in the axial direction being longer than the through hole 41, by the length corresponding to the movement of the prolate spheroid portion 50*a* from the point in the stationary state to the point when the opening of the connecting portion 30*r* is blocked.

The protrusion 50*c* is curved in a direction where the diameter expanding gradually from the lower portion toward the upper portion, the portion where the diameter is the largest has the size that allows movement through the through hole 41 of the plug member 40, maintaining contact with the inner peripheral surface 41*b*. In the stationary state, the lower end of the projection 50*c* is positioned above the through hole 41 of the plug member 40. When the shaft member 50 is lowered toward the stem 23, the lower end of the protrusion 50*c* comes into contact with the upper end of the inner peripheral surface 41*b* on the elastic member 42 side. Further descent of the shaft member 50 pushes the inner peripheral surface 41*b* to the elastic member 42 side, along the curved surface of the protrusion 50*c*. Then, the tip end 40*a* of the plug member 40 goes away from the spray port 33. When the shaft member 50 is moved vertically, the shaft portion 50*d* is moved vertically in contact with the inner peripheral surface of the cylinder 30*c*.

The push button 51 is fixed on the upper end of the shaft portion 50*d*, and supported on the outer cylinder 30 via the elastic member 60. The push button 51 is formed of a disk 51A provided on the upper end of the shaft portion 50*d*, and a cylinder 52 fixed around the disk 51A. The lower end of the elastic member 60 is fixed between the cylinder 30*c* and the cylinder 30*d* of the outer cylinder 30, and the upper end of the elastic member 60 is fixed to the lower surface of the disk 51A.

On the lower end of the cylinder 52, an inner rim expands in the inner circumferential direction, forming an annular portion 52*e* that has a thickness in the vertical direction. In the stationary state, the upper surface of the annular portion 52*e* is in contact with the lower surface of the annular portion 30*e* of the cylinder 30*d*. When the shaft member 50 moves up and down with respect to the outer cylinder 30, the inner peripheral surface of the cylinder 52 is in contact with the outer peripheral surface of the annular portion 30*e* of the cylinder 30*d*, and the inner peripheral surface of the annular portion 52*e* moves up and down in a stable manner, maintaining contact with the outer peripheral surface of the cylinder 30*d*.

As materials of the outer cylinder 30 and the shaft member 50, it is possible to use a resin such as polypropylene, high-concentration polyethylene, polyacetal, and polybutyleneterephthalate. The plug member 40 may be made of a material such as polypropylene, high concentration polyethylene, polyacetal, and polybutylene terephthalate. Any member having an elastic force such as a resin spring, a metal spring, and a coil spring, may be used as the elastic members 60 and 42.

(Metered Spray Unit 10B of Embodiment 2)

Figure 5:
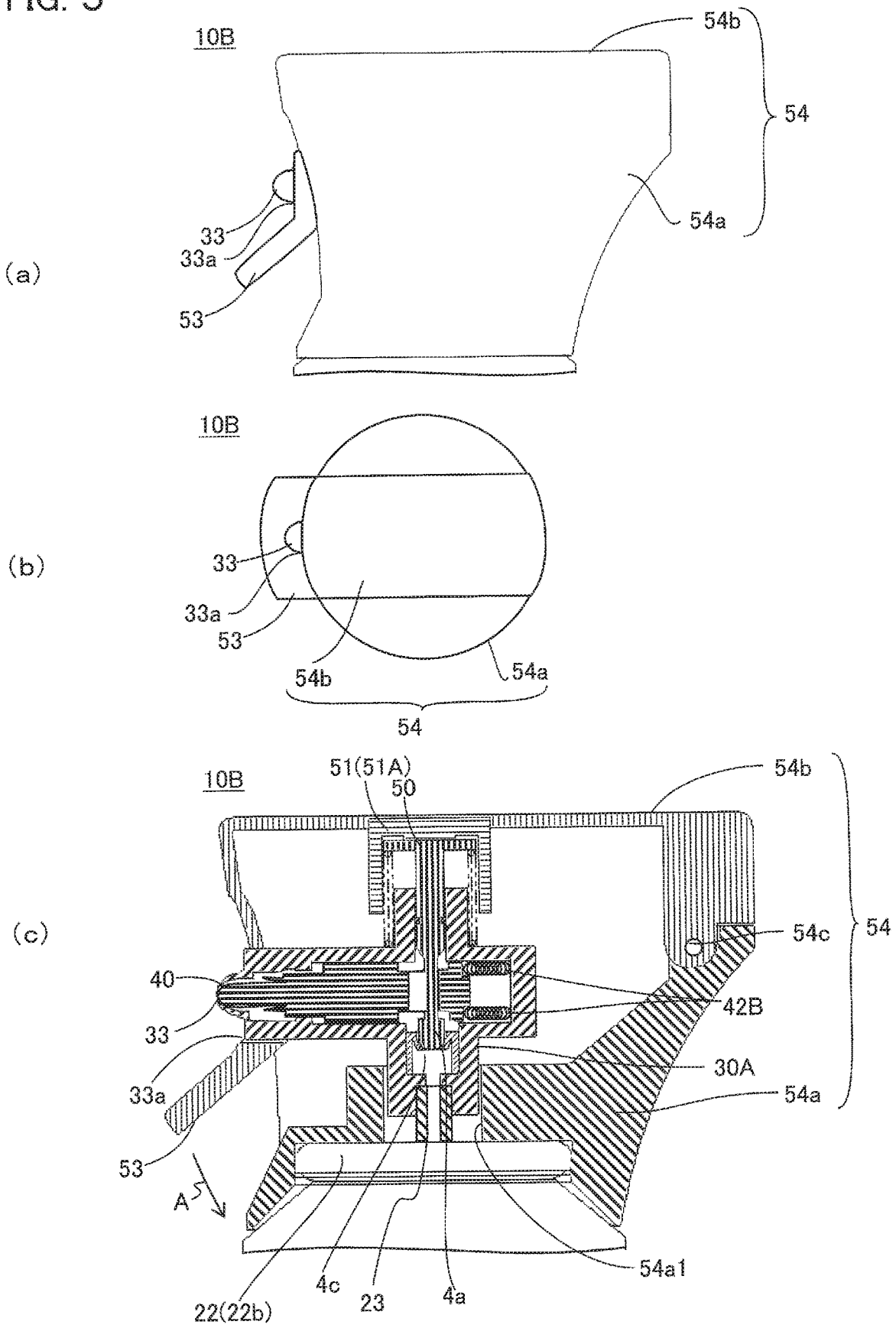
FIG. 5(*a*) is a side view, FIG. 5(*b*) is a plan view, and FIG. 5 (*c*) is a cross-sectional view of the metered spray unit 10B according to a second embodiment.

With reference to FIG. 5, the metered spray unit 10B of the second embodiment will be described. FIG. 5 (*a*) is a side view, FIG. 5 (*b*) is a plan view from above, and FIG. 5 (*c*) is a cross-sectional view of the metered spray unit 10B of the second embodiment. The metered spray unit 10B differs from the metered spray unit 10A of the first embodiment, in a point that the contents are sprayed when a lever 53 is pulled. Hereinafter, the metered spray unit 10B will be described, with regard to a configuration different from the metered spray unit 10A.

The metered spray unit 10B includes a lever 53, a cover member 54 in contact with the push button 51, and a mechanism portion 54*a*1 for converting the displacement of the lever 53 into the displacement of the cover member 54 in a direction of depressing the push button 51. The cover member 54 is detachably attached to the stem 23, and covers the upper portion and the side of the metered spray unit 10B. Hereinafter, the configuration of the cover member 54 will be described in detail.

The cover member 54 comprises a cylindrical cover base 54*a* which is detachably fixed to the container body 21, being engaged with the outer periphery of the mountain cup 22*b* of the valve 22, and the rotating portion 54*b* rotatably attached to the rotating shaft 54*c* with respect to the cover base 54*a*. As shown in FIG. 5(*b*), the upper surface of the cover member 54 has a shape being split into two portions; a circular upper surface portion continuous with the cover base 54*a*, and a strip-shaped rotating portion 54*b* provided in the center. At one end of the spray port 33 side of the rotating portion 54*b*, the lever 53 is provided. When a user pulls the lever 53 to bring the lever 53 closer to the central axis of the stem 23, the rotating portion 54*b* is rotated about the rotation axis 54*c* perpendicular to the axial direction of the stem 23.

As shown in FIG. 5 (*c*), the lever 53 extends from the lower portion of the spray port 33, being inclined with respect to the axial direction of the stem 23, and the tip of the lever 53 is provided below the rotary shaft 54*b*. A hole 33*a* for allowing the spray port 33 to pass through is provided on the upper portion of the lever 53, and the spray port 33 protrudes from the hole 33*a*.

A disk 51A of the push button 51 is fitted from below, into the top plate in the upper part of the rotating portion 54*b*. Further, the cover base 54*a* has a cylindrical hole (mechanism portion 54*a*1) in the center portion, and the inner peripheral surface of the mechanism portion 54*a*1 has an inner diameter slightly larger than the outer periphery of the outer cylinder lower portion 30A.

The configuration of the cover member 54 is not limited to the configuration described above, as far as it is detachable with respect to the container body 21 and it is possible to press the disc 51A along the axial direction of the stem 23.

Incidentally, a coil spring 42B is used as the elastic member 42 for urging the plug member 40 to the spray port 33 side in the present embodiment.

The operation example of the metered spray unit 10B is substantially the same as that of the metered spray unit 10A of the first embodiment, but a method for pressing the push button 51 by the user is different from that of the metered spray unit 10A. In the metered spray unit 10B, the user pulls the lever 53 with a finger or the like, whereby the push button 51 is depressed. The operation thereof will be described in detail.

First, when the user pulls the lever 53 with a finger or the like in the arrow A direction, rotating portion 54*b* rotates in a direction approaching the stem 23 about the rotation axis 54*c*. The rotation of rotating portion 54*b* causes the top plate of the rotating portion 54 to depress the push button 51. When the push button 51 is depressed, the outer cylinder lower 30A is moved while in contact with the mechanism portion 54*a*1, whereby the displacement due to the rotation of rotating portion 54*b* is converted to the displacement of the cover member 54 in the direction of pressing the push button 51. Then, the outer cylinder lower portion 30A presses the stem 23 along the axial direction, and accordingly, the stem 23 is pressed along the axial direction.

Further, when the user releases the finger or the like, from the lever 53, and the lever 53 is rotated in the direction opposite to the arrow A, and the outer cylinder lower portion 30A is moved while in contact with the mechanism portion 54*a*1, whereby the displacement due to the rotation of the lever 53 is converted to the displacement of the cover member 54 in the direction of pulling up the push button 51, and depressing of the push button 51 is released.

As described above, the metered spray unit 10B of the second embodiment has a configuration in which the user can push down the stem 23 on the principle of leverage, by lightly pulling the lever 53 with a finger. Therefore, the metered spray unit 10B produces an effect in addition to the effect obtained by the metered spray unit 10A of the first embodiment, that the user can perform the operation of spraying the contents in a fixed amount, by applying a lighter force to the lever 53.

The mechanism for pressing the shaft member 50 is not limited to this example. For example, the push button 51 may be omitted, the position of the lever 53 and the position of the rotary shaft 54*b* may be different from the positions as described above, and the shaft member 50 may be depressed when the user presses a push button provided on the side surface of the outer cylinder 30. Also, the direction of the spray port 33 is not limited to the direction perpendicular to the axial direction of the stem 23. Further, the contents may be spayed in the axial direction of the stem 23, or the contents may be sprayed in the direction inclined with respect to the axial direction of the stem 23.

(Metered Spray Unit 10C of Embodiment 3)

Figure 6:
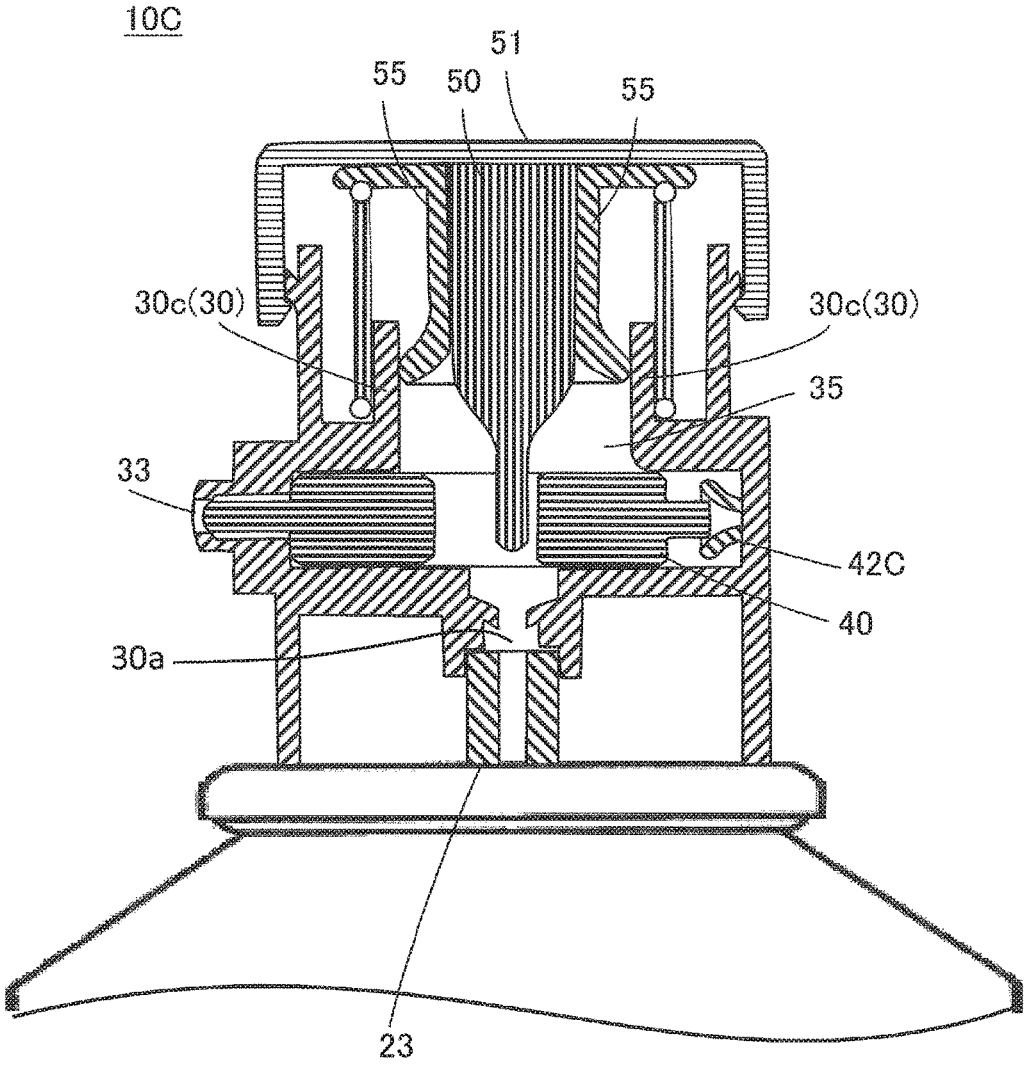
FIG. 6 is a cross-sectional view of the metered spray unit 10C according to a third embodiment.

With reference to FIG. 6, the metered spray unit 10C of the third embodiment will be described. The metered spray unit 10C includes a space between the shaft member 50 and the cylinder 30*c* of the outer cylinder 30, and a seal valve 55 is provided in this space. That is, the metered spray unit 10C differs from the metered spray units 10A and 10B described above in a point that the seal valve 55 is disposed around the shaft member 50, and the seal valve 55 restricts the upward movement of the contents filled in the metering chamber 35.

The upper portion of the seal valve 55 is fixed to the periphery of the shaft member 50 and to the disc 51, and the lower portion of the seal valve 55 expands outwardly like a collar. The lower end of the seal valve 55 is in contact with the cylinder 30*c* of the outer cylinder 30, and the lower portion of the seal valve 55 forms an upper end portion of the stem insertion hole 30*a* of the metering chamber 35.

When the shaft member 50 is pressed along the axial direction of the stem 23 from the stationary state, the lower end of the seal valve 55 is pressed while in contact with the cylinder 30*c*, and then, the lower end of the seal valve is bent upwardly. With this configuration, the seal valve 55 can prevent the contents filled in the metering chamber 35 from flowing out, from between the shaft member 50 and the cylinder 30*c* of the outer cylinder 30, toward the upper end of the cylinder 30*c*.

As the elastic member 42 for urging the plug member 40 of the present embodiment, a valve-shaped elastic member 42C having the same shape as the lower portion of the seal valve 55 is used. The valve-shaped elastic member 42C has its tip extending toward the plug member 40. Inside the tip of the elastic member 42C being extended, the end portion of the plug member 40 is inserted and brought into contact therewith. When the plug member 40 is moved toward the elastic member 42C side by the movement of the shaft member 50, the elastic member 42C is pushed and deflected by the end portion of the plug member 40, and an elastic force is applied, trying to return the plug member 40 to the spray port 33 side.

For example, a resin such as polyethylene or a rubber member may be used for the seal valve 55, and a member having an elastic force such as polypropylene, high concentration polyethylene, polyacetal, or polybutylene terephthalate may be used for the material of the elastic member 42C.

In the above-described metered spray units 10A to 10C, the shaft member 50, the push button 51, and the seal valve 55 may be integrally formed.

DESCRIPTION OF SYMBOLS

10 . . . metered spray unit, 20 . . . metered spray container, 21 . . . container body, 22 . . . valve, 23 . . . stem, 30 . . . outer cylinder, 30*a* . . . stem insertion hole, 30*r* . . . connecting portion, 32 . . . valve, 33 . . . spray port, 35 . . . metering chamber, 40 . . . plug member, 50 . . . shaft member, 51 . . . push button, 60 . . . elastic member, 53 . . . lever, 54 . . . cover member

What is claimed is:

1. A metered spray unit mounted on a stem of a valve provided on an upper portion of a container body for spraying a predetermined amount of contents in the container body, comprising, an outer cylinder provided with a stem insertion hole into which a tip of the stem is inserted and an inner wall of the stem insertion hole is fixed to the stem, a metering chamber being an internal space having a predetermined capacity connected to the stem insertion hole, and a spray port communicating with the metering chamber, a plug member inserted into the spray port from an inside of the metering chamber, to block the spray port, a push button, an elastic member configured to support the push button on the outer cylinder, and a shaft member connected to the push button, wherein a displacement amount of the elastic member due to the pressing force applied to the push button is smaller than the displacement amount when applying the same pressing force to a spring for urging the stem within the valve.

2. The metered spray unit according to claim 1, wherein when the push button is pressed, the outer cylinder and the stem descend by a larger amount than the displacement amount of the elastic member, and the stem injects the contents into the stem insertion hole.

3. The metered spray unit according to claim 2, wherein the shaft member has a structure for blocking an opening of a connecting portion that connects the metering chamber and the stem insertion hole, by descending along with depression of the push button, and a structure for moving the plug member in a direction for opening the spray port, along with blocking the opening of the connecting portion.

4. The metered spray unit according to claim 3, wherein descending of the outer cylinder and the stem, blocking of the opening of the connecting portion by the shaft member, and opening of the spray port by the plug member occur in this order, when the push button is pressed.

5. The metered spray unit according to claim 3, wherein the shaft member is arranged so that an axial direction thereof coincides with an axial direction of the stem, and the shaft member has a tip end directed downwardly, and the tip end of the shaft member is sized to close and seal the opening of the connecting portion, when inserted into the opening of the connecting portion between the metering chamber and the stem insertion hole.

6. The metered spray unit according to claim 5, wherein a valve having flexibility is disposed on an inner periphery of the opening of the connecting portion between the metering chamber and the stem insertion hole, and the tip end of the shaft member is inserted into the valve to block the opening.

7. The metered spray unit according to claim 1, wherein the stem insertion hole of the outer cylinder has an inner diameter that allows the inner wall of the stem insertion hole to be in close contact with an outer wall of the stem to maintain airtightness.

8. The metered spray unit according to claim 1, wherein the shaft member has a protrusion, and descending of the shaft member along with pressing the push button causes the protrusion to come into contact with the plug member, and to push and move the plug member in a direction to open the spray port.

9. The metered spray unit according to claim 8, wherein the plug member has a through hole passing through in an axial direction of the shaft member, and the shaft member is disposed to pass through the through hole of the plug member, and the protrusion of the shaft member is lowered by pressing the push button and inserted into the through hole of the plug member to contact with the plug member, and then the protrusion pushes and moves the plug member in the direction of opening the spray port.

10. The metered spray unit according to claim 1, wherein the moving direction of the plug member is a direction orthogonal to an axial direction of the shaft member.

11. The metered spray unit according to claim 1, further comprising a second elastic member configured to urge the plug member in a direction to press the plug member against the spray port.

12. The metered spray unit according to claim 1, wherein the plug member is entirely disposed in the metering chamber of the outer cylinder.

13. The metered spray unit according to claim 1, comprising a lever, a cover member in contact with the push button, and a mechanism for converting displacement of the lever into displacement of the cover member in a direction in which the push button is pressed.

* * * * *